US005411411A

United States Patent [19]

Ogawa et al.

[11] Patent Number: 5,411,411

[45] Date of Patent: May 2, 1995

[54] BULB SOCKET

[75] Inventors: Shinji Ogawa, Yokkaichi; Masayoshi Matsumoto, Isehara, both of Japan

[73] Assignees: Sumitomo Wiring Systems, Ltd., Yokkaichi; Ichikoh Industries, Ltd., Tokyo, both of Japan

[21] Appl. No.: 145,638

[22] Filed: Nov. 4, 1993

[30] Foreign Application Priority Data

Nov. 13, 1992 [JP] Japan ..... 4-078229 U

[51] Int. Cl.[6] ..... H01R 4/50

[52] U.S. Cl. ..... 439/336; 439/611

[58] Field of Search ..... 439/336, 356, 611–619

[56] References Cited

U.S. PATENT DOCUMENTS 4,146,294 3/1979 Kornatowski et al. ..... 439/701 X

FOREIGN PATENT DOCUMENTS 62-18988 2/1987 Japan .

4136890 12/1992 Japan .

*Primary Examiner*—Khiem Nguyen

*Attorney, Agent, or Firm*—Sandler, Greenblum & Bernstein

[57] ABSTRACT

A projection is provided on a negative terminal projecting toward the socket center and positioned directly below the bottom of the bulb base, a cut-out recessed to the bottom is provided in the top of the base part, which is positioned along the bottom of the bulb insertion opening and is bent in the perpendicular horizontal direction from the bottom of the flat member, and the base part is set to not contact the positive terminal when positioned with the projection contacting the bottom shoulder of the bulb base.

6 Claims, 8 Drawing Sheets

BULB SOCKET

BACKGROUND OF THE INVENTION

1. Field of the Invention

The present invention relates to a bulb socket for use mainly in automotive lights and, more particularly, to a bulb socket for a bulb of the kind having two filaments each connected to positive and negative terminals provided inside the bulb socket. The present invention has been made to provide a bulb socket with improved negative and positive terminals so as to prevent the negative terminal from short-circuiting with the positive terminal even when the negative terminal moves away from the normal position in the socket.

2. Description of the Prior Art

In FIGS. 5 and 6, a conventional bulb socket for housing a single-filament bulb having one filament is shown. A negative terminal 2 and positive terminal 3 are provided by insertion to the bulb socket 1 (FIG. 5). A bulb 4, indicated by an imaginary line in FIG. 6, is inserted to the bulb insertion opening 1*a* of the bulb socket 1. The bulb-side contacting element 2*a* of the negative terminal 2 contacts the negative electrode of the outside circumference of the bulb base 4*a*. A bulb-side contacting element 3*a* of the positive terminal 3 contacts the positive electrode 4*b* of the bulb base 4*a*. A connector element 2*b* of the negative terminal 2 and a connector element of the positive terminal 3 project into a connector insertion part 1*b* of the bulb socket 1, in which each of connector elements are connected with external connectors (not shown) inserted to the connector insertion part 1*b*.

The positive terminal 3 is securely held in the bulb socket 1 because the bulb-side contacting element 3*a* is pressured from above by the bulb 4. Because the negative terminal 2 is held in the socket 1 only by an engaging piece 2*c* engaged with the lock channel 1*c* of the bulb socket 1, it is not securely locked. And because the engaging piece 2*c* is often extremely small and has no engaging margin, the negative terminal 2 is not securely locked in some cases.

In particular, when installed in a motor vehicle and subjected to vibrations, etc., for extended periods of time, the engaging piece 2*c* easily disengages. When the engaging piece 2*c* disengages and is removed from an insertion hole 1*d*, a base part 2*d* of the negative terminal 2 contacts the curved contacting element 3*a* of the positive terminal 3 positioned thereabove at an encircled area X in FIG. 6.

In FIG. 7, another conventional negative terminal proposed in Japanese Utility Model Laid-open Publication (unexamined) No. H4-136890 issued Dec. 21, 1992 is shown. In FIG. 8A, the conventional bulb socket 2 viewed at other angle than at FIG. 6 is shown. This negative terminal 2 comprises a projection 2*f* projecting from the flat member below the bulb-side contacting element 2*a*. The projection 2*f* projects inside of the bulb insertion opening 1*a* when the negative terminal 2 is installed in the bulb socket 1.

When the engaging piece 2*c* disengages from the lock channel 1*c*, the negative terminal 2 comes out from the insertion hole 1*d* and moves toward the bulb-side contacting element 3*a* located thereabove. Before the top of a base part 2*d* of the negative terminal 2 contacts the contacting element 3*a* at a position P on a dot line L, the front edge 2*s* of projection 2*f* abuts on the shoulder of bulb base 4*a*, so that the negative terminal 2 is stopped thereat so as not to contact with the positive terminal 3. Thus, the short-cutting of the negative terminal 2 with the positive terminal 3 is prevented.

In FIG. 8B, a relationship of the gap between the negative terminal 2 and the positive terminal is shown. In the case of a single bulb shown in FIG. 5, the base part 2*d* of the negative terminal 2 is positioned at the bottom side of the bulb-side contacting element 3*a* of the positive terminal 3, and there is a large gap G2 between the base part 2*d* and the contact point P of the bulb-side connector 3*a* directly above.

Because there is a large gap G2 with a single bulb, and said gap G2 is larger than the gap between the bottom of the bulb base 4*a* and the projection 2*f* of the negative terminal 2 in the normal engagement position, the projection 2*f* is always stopped by the bulb base 4*a* before the base part 2*d* of the negative terminal 2 contacts the contacting element 3*a* of the positive terminal 3, preventing short-circuiting.

As described above, when a single-filament bulb 4 is installed in the bulb socket 1 provided with a single of positive terminal 3 and negative terminal 2, the negative terminal 2 shaped as described above is kept from contacting with the positive terminal 3.

However, in the case of the bulb socket 1 which is used for housing a double-filament bulb 4 having two filaments, two positive terminals 3 and one negative terminal 2 are provided therein, as shown in FIGS. 9 and 10A. Specifically, the negative terminal 2 is positioned under the one of the bulb-side contacting elements 3*a* positioned parallel to each other on the bottom side of the bulb insertion opening 1*a*. In other words, since the bottom of the bulb-side contacting element 3*a* is positioned directly above the base part 2*d*, it is impossible to form a gap G1 having a greater clearance between the base part 2*d* and a contact point P on the bottom surface of bulb-side contacting element 3*a*. As a result, the gap G1 is smaller than the gap G6 formed between the bottom of bulb base 4*a* and the projection of the negative terminal 2*f*, as best shown in FIG. 10A.

In FIG. 10B, the relationship of the gaps formed among the negative terminal 2, positive terminal 3, and bulb base 4*a* inside thus formed bulb socket 2 is shown. Since the gap G1 is smaller than the gap G6, the base part 2*d* contacts with the contact point P of bulb-side contacting element 3*a* before the projection 2*f* is stopped by the shoulder of bulb base 4*a*, and thus the short-circuiting can not be prevented.

SUMMARY OF THE INVENTION

The object of the present invention is therefore to provide a terminal which solves these problems.

The present invention has been developed with a view to substantially solving the above described disadvantages and has for its essential object to provide an improved bulb socket for receiving a bulb having a base electrode formed on the outer perimeter of a base thereof and a bottom electrode formed on the bottom of said base, said bulb socket comprises a first terminal having first contacting member for the electric connection with said bottom electrode, and a second terminal comprises a second contacting member for the electric connection with said base electrode; a projection extending toward the socket center below said base; and a base member extending below said positive electrode, said base member having a portion removed from the top surface thereof so as not to contact said positive terminal in the position where said projection contacts the bottom surface of said base.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

Figure 1:
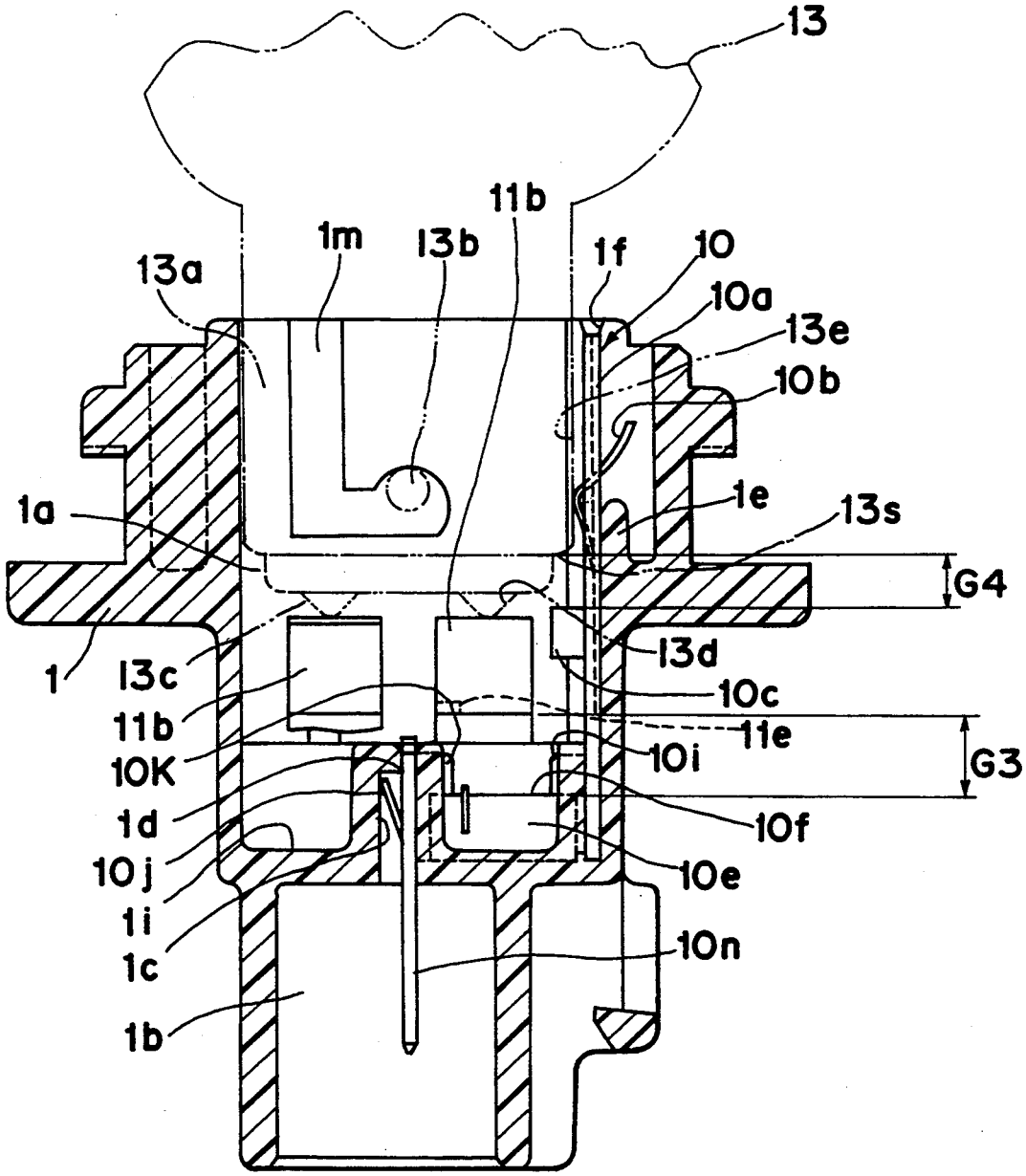
FIG. 1 is a cross-sectional view schematically showing a bulb socket according to a preferred embodiment of the present invention.

Referring to FIG. 1, a bulb socket according to the present invention is shown. A bulb 13 indicated by an imaginary line is a double-filament bulb having two filaments (not shown) connected to a single base electrode 13*e* formed on an outer perimeter of a bulb base 13*a*. And each of two filaments is further connected to first and second bottom electrode 13*c* and 13*d*, respectively, formed on the bottom surface of the bulb base 13*a*.

Figure 9:
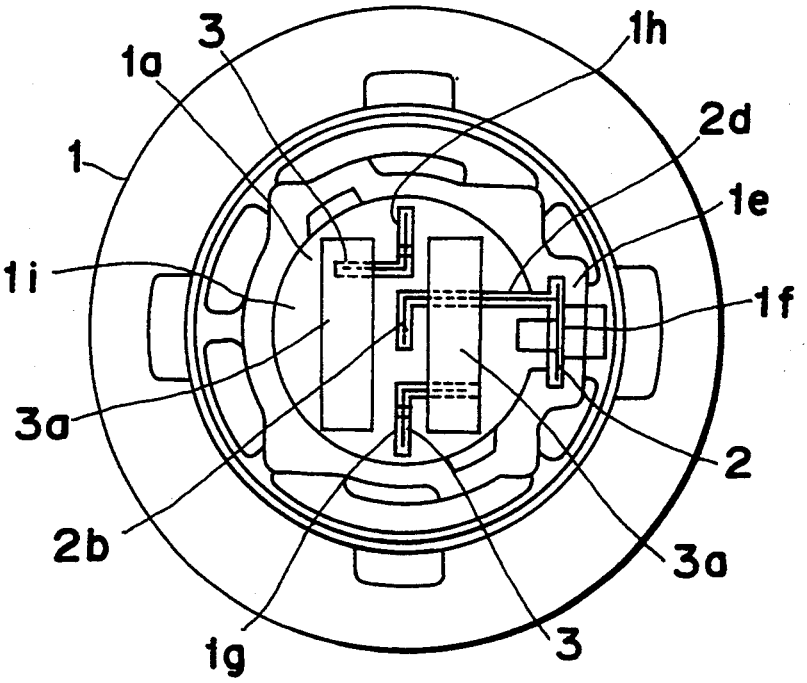
Fig. 9 PRIOR ART
FIG. 9 is a top view showing a conventional bulb socket for housing a double-filament bulb.
Figure 10A:
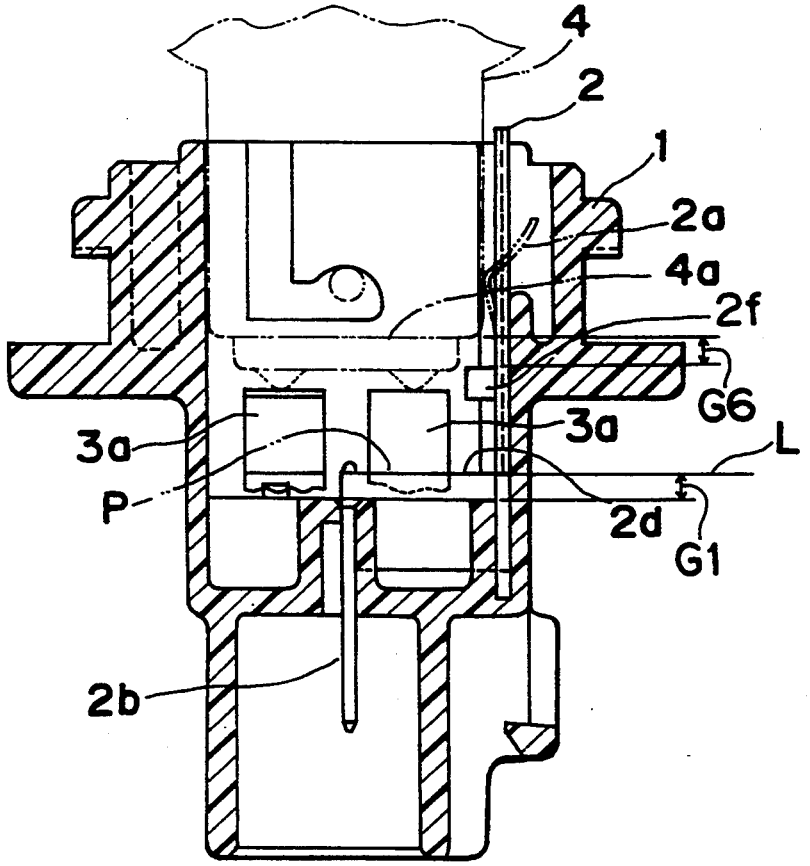
Fig. 10A PRIOR ART
FIG. 10A is a cross-sectional view showing the bulb socket of FIG. 9 when the negative terminal is disengaged.

Specifically, a bulb socket 1 is an integral molding of an insulating resin in which a terminal insertion channel 1*f* is formed in a surrounding wall 1*e* of a bulb insertion opening 1*a* formed at one side. The bulb socket 1 further has two positive terminal insertion holes 1*g* and 1*h* (FIG. 9) formed in a bottom wall 1*i* of the bulb insertion opening 1*a*.

A connector insertion opening 1*b* is formed in the bottom wall 1*i* of the bulb insertion opening 1*a*. An insertion hole 1*d* for inserting a connector-side connector 10*n* of the negative terminal 10 is formed in the center of the bottom wall 1*i*, and the lock channel 1*c* is further formed in the side wall of the insertion hole 1*d*. The negative terminal 10 installed by insertion to the bulb socket 1 from the terminal insertion channel 1*f*.

Figure 2A:
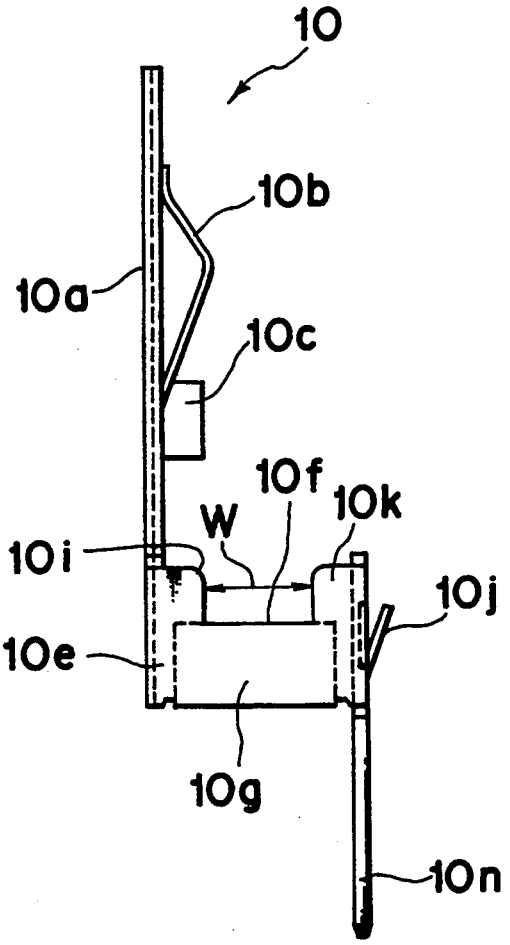
FIG. 2A is a side view showing a negative terminal for electrically connecting with a negative electrode of the bulb housed in the bulb socket of FIG. 1.
Figure 2B:
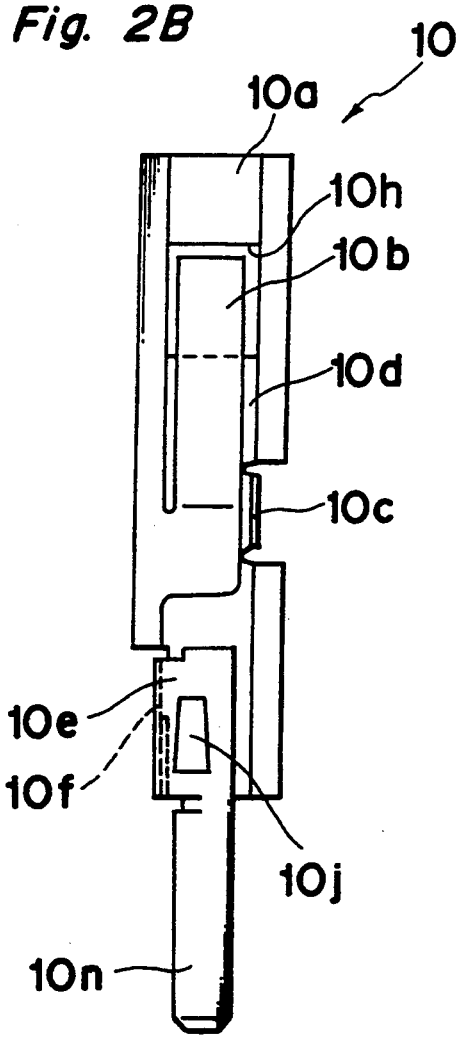
FIG. 2B is a plan view showing the negative terminal of FIG. 2A.
Figure 2C:
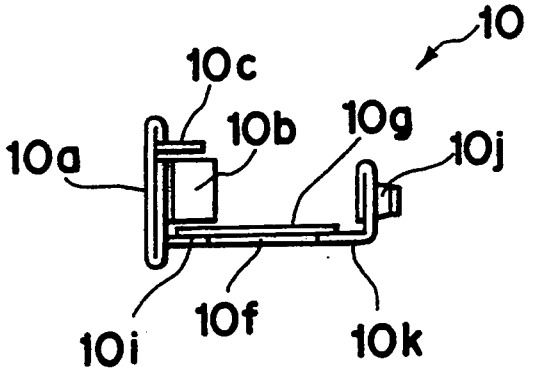
FIG. 2C is a bottom view showing the negative terminal of FIG. 2B.
Figure 3A:
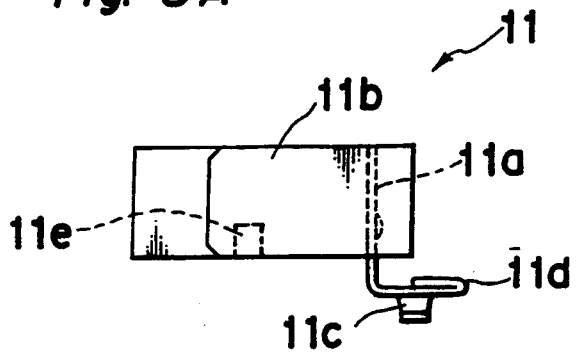
FIG. 3A is a top view showing a positive terminal for electrically connecting with a positive electrode of the bulb housed in the the bulb socket of FIG. 1.
Figure 3B:
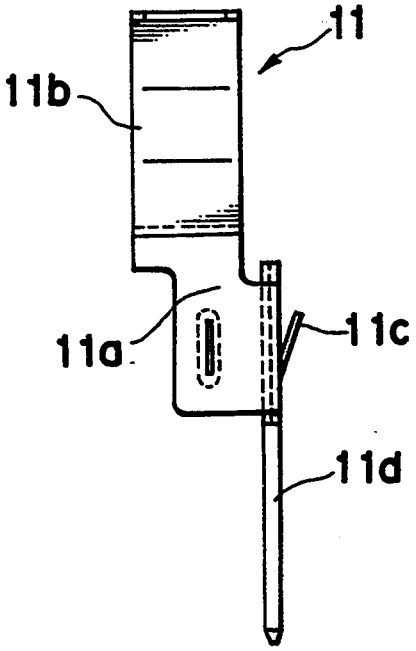
FIG. 3B is a side view showing the positive terminal of FIG. 3A.
Figure 3C:
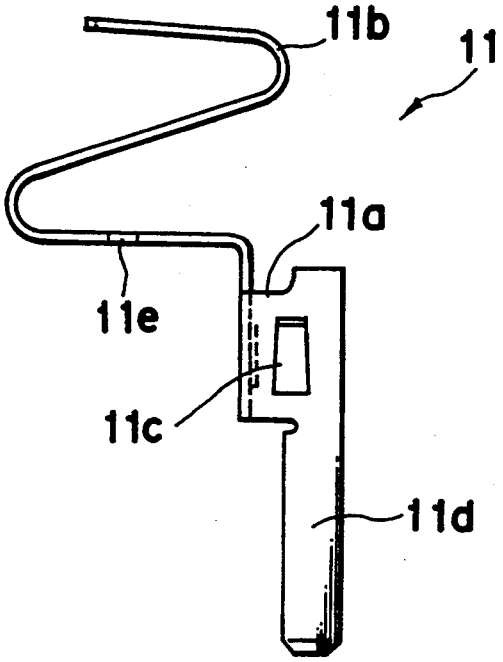
FIG. 3C is a front view showing the positive terminal of FIG. 3A.
Figure 3D:
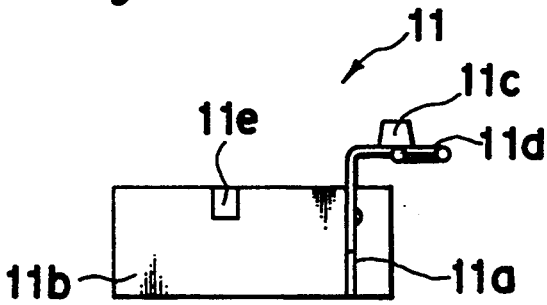
FIG. 3D is a bottom view showing the positive terminal of FIG. 3A.

Referring to FIGS. 2A, 2B, and 2C, the negative terminal 10 formed by bending a single thin strip-shaped metal piece is shown. Both long sides of a flat member 10*a* are folded back overlapping to a center part 10*d*. And the bulb-side contacting element 10*b* is formed at one of longer sides to be located preferably at the center of the center part when folded. Specifically, the bulb-side contacting element 10*b* is raised from the flat member 10*a*. The bulb-side contacting element 10*b* is bent back toward the flat member 10*a* at the middle so as to configure a generally V-shape. Thus, bent element 10*b* can resiliently swing in a direction perpendicular to the flat member 10*a* with respect to the base portion. The negative terminal 10 is further provided with a projection 10*c* formed at the side edge portion near the bottom of the bulb-side contacting element 10*b*. The projection 10*c* extends in the same direction in which the contacting element 10*b* is bent up. A clearance hole 10*h* is formed in the center 10*d* so as to oppose to the free end portion the contacting element 10*b* such that the contacting member 10*b* can move into the back side of the flat member 10*a* when pressed.

A base member 10*e* is provided at the bottom of the flat member 10*a*, and is extending in the horizontal direction perpendicular to the flat member 10*a*. The base member 10*e* has a channel-shaped recess 10*f*, generally in a U-shaped configuration in which a top center portion of base member 10*a* is removed and shoulder parts 10*i* and 10*k* are formed on both side portions thereof. The shoulder parts 10*i* and 10*k* are located near the flat member 10*a* and the connector-side connector 10*n*, respectively. The bottom part 10*e* is doubled over by a bottom part 10*g* for increased strength.

The greater the width W defined by both elevated walls of U-shaped recess 10*f*, contact with the positive terminal 11 can be prevented. Because of increasing width W weakens the strength of the base member 10*e*, shoulder parts 10*i* and 10*k* are left on both sides.

The base member 10*e* is folded in a direction to oppose the flat member 10*a*, as best shown in FIG. 2C. An engaging piece 10*j* is raised at the end of thus folded base member 10*e* remote from the flat member 10*a*. The connector-side connector 10*n* is formed doubled over and extending from thus folded base member 10*e* in a direction preferably parallel to and apart from the flat member 10*a*.

As shown in FIG. 1, the negative terminal 10 is assembled in the bulb socket 1 with the flat member 10*a* inserted through the top opening 1*a* to the terminal insertion channel 1*f*. The connector-side connector 10*n* passes through the insertion hole 1*d* of the bottom wall 1*i* of the bulb insertion opening 1*a*, projecting into the connector insertion opening 1*b*, and the engaging piece 10*j* engages the channel 1*c*, and holds the negative terminal 10 at the normal position.

With the negative terminal 10 in the above normal installation position, the bulb-side contacting element 10*b* and projection 10*c* project to the socket center side.

Referring to FIGS. 3A, 3B, 3C, and 3D, the positive terminal 11 formed by bending a single thin strip-shaped metal piece is shown. The positive terminal 11 has a spring-like bulb-side contacting element 11*b* formed into an approximate Z-shape, a connector-side connector 11*d*, and a base part 11*a* connecting therebetween.

The base part 11*a* is provided at the bottom of the contacting element 11*b* and extends in a direction perpendicular thereto. The base part 11*a* has an engaging piece 11*c* raised therefrom for the engagement with the socket 1. The connector-side connector 11d extends toward the bottom from one end of the base part 11*a*.

The bulb-side contacting element 11*b* is provided with a clearance channel 11*e* formed in one side of the horizontal part of the bottom-most part thereof. The positive terminal 11 is installed in the socket 1 such that the clearance channel 11*e* is set to be positioned directly over the shoulder part 10*k* of the negative terminal 10.

The two positive terminals 11 are installed with the connector-side connector 11*d* inserted to the insertion holes 1*g* and 1*h*, respectively, formed in the bottom wall 1*i* of the socket 1. In this case, the engaging piece 11*c* engages the lock channel of the socket 1, and the bulb-side contacting element 11*b* projects parallel to the bottom of the bulb insertion opening 1*a*. The base part 10*e* of the previously installed negative terminal 10 is positioned at the bottom of one of the bulb-side contacting element 11*b*.

As shown in FIG. 1, a gap G3 is formed between the bottom of recess 10*f* of the negative terminal 10 and the bottom-most horizontal part of the bulb-side contacting element 11*b* directly above the base part 10*e*.

After installing one negative terminal 10 and two positive terminals 11 in the bulb socket 1 as above, the double-filament bulb 13 is installed. The pin 13*b* projecting from the base 13*a* of the bulb 13 is inserted to the L-shaped pin insertion channel 1*m* formed in the surrounding wall of the bulb insertion hole 1*a*, and the bulb 13 is turned and engaged in the bulb socket 1.

With the bulb 13 installed, the bulb-side contacting element 10*b* of the negative terminal 10 contacts the base electrode (negative terminal) 13*e* of the bulb 13. In addition, the bulb-side contacting elements 11*b* of the positive terminals 11 contact two bottom electrodes (positive terminals) 13*c* and 13*d* provided on the bottom of the bulb base 13*a*.

The projection 10*c* of the negative terminal 10 also projects to the position directly below the bottom surface 13*s* of the base 13*a*. The gap between the top surface of the projection 10*c* and the bulb base bottom surface 13*s* is G4, and gap G4 is set smaller than gap G3.

Thus, when a bulb socket 1 with the negative terminal 10, positive terminals 11, and bulb 13 installed therein is mounted in a motor vehicle, etc., and vibration is applied, the engaging piece 10*j* of the negative terminal 10 disengages from the socket lock channel 1*c*, and the negative terminal 10 comes out.

Figure 4A:
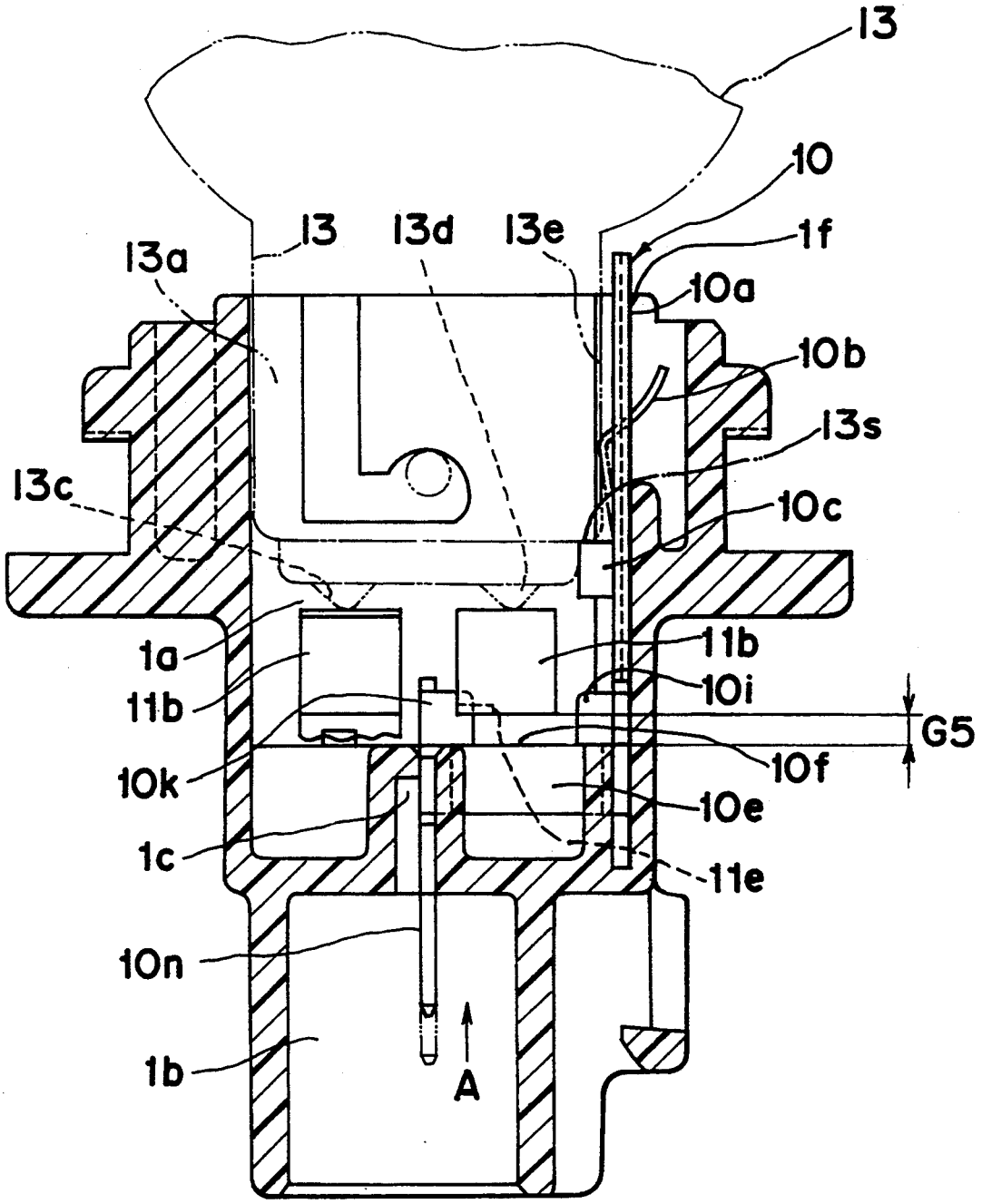
FIG. 4A is a cross-sectional view showing the bulb socket of FIG. 1 when the negative terminal is disengaged.
Figure 10B:
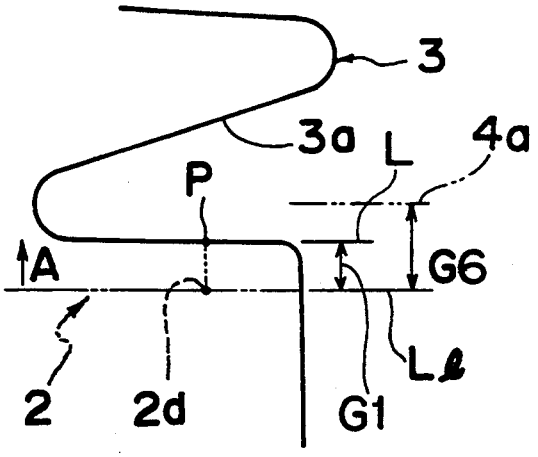
Fig. 10B PRIOR ART
FIG. 10B is a graph in assistance of explaining the relationship of gaps between the negative terminal and positive terminal in the bulb socket of FIG. 10A.

Referring to FIG. 4A, the bulb socket 1 when the negative terminal 10 disengaged from the socket lock 1*c* is shown. The projection 10*c* positioned directly below the bottom of the bulb base 13*a* rises and the top thereof contacts the bottom shoulder 13*s* of the bulb base 13*a* after moving through gap G4. Thus, the negative terminal 10 is stopped and held in this position.

In this stopped position, there is also a gap G5 between the recess 10*f* of negative terminal 10 and the bottom-most horizontal part 11*b* of the positive terminals 11.

The shoulder part 10*k*, located near the positive terminal 11, can rise through the clearance channel 11*e* formed in the bottom-most part of the positive terminals 11 without the contact to the positive terminal 11.

Thus, with the projection 10*c* of the negative terminal 10 being stopped against the bulb base bottom 13*s*, the negative terminal 10 and positive terminals 11 do not connect, and short-circuiting is prevented.

Figure 4B:
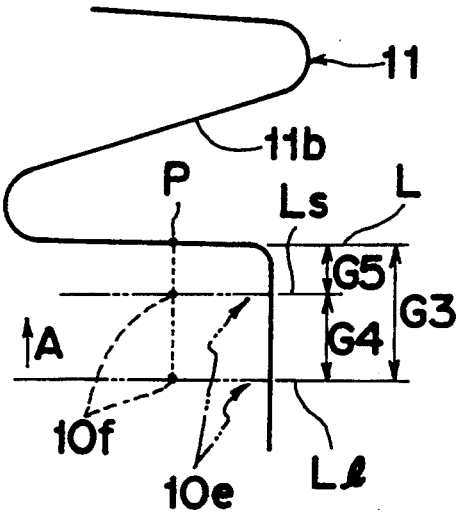
FIG. 4B is a graph in assistance of explaining the relationship of gaps between the negative terminal and positive terminal in the bulb socket of FIG. 4A.
Figure 8B:
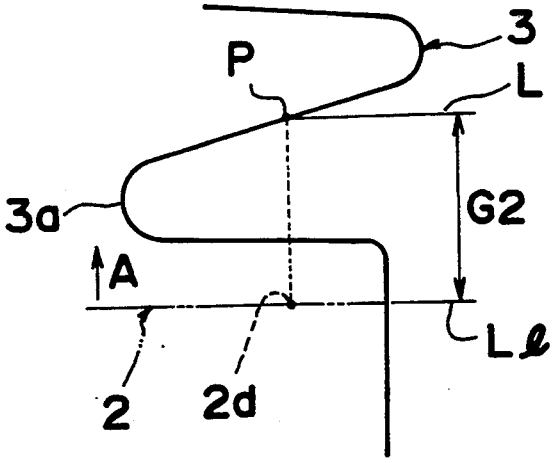
Fig. 8B PRIOR ART
FIG. 8B is a graph in assistance of explaining the relationship of gaps between the negative terminal and positive terminal in the bulb socket of FIG. 8A.
Figure 5:
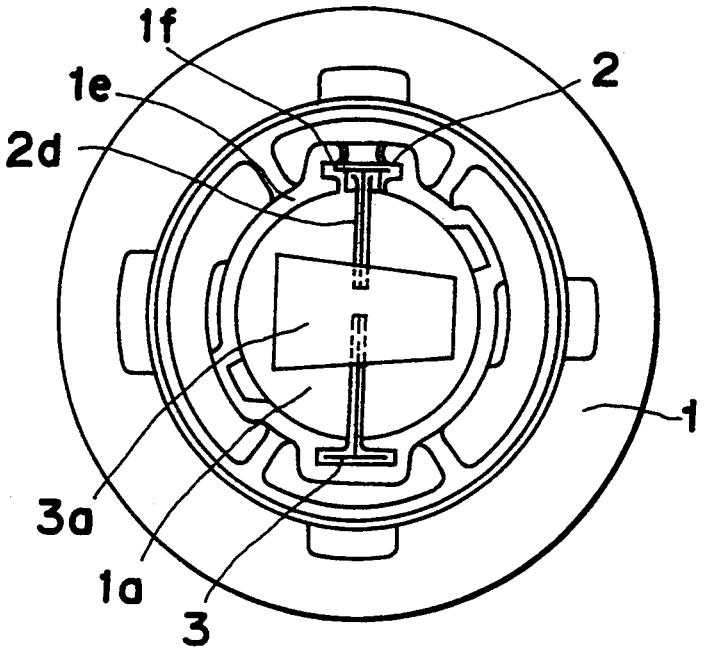
Fig. 5 PRIOR ART
FIG. 5 is a top view schematically showing a conventional bulb socket for housing a bulb having a single filament.
Figure 6:
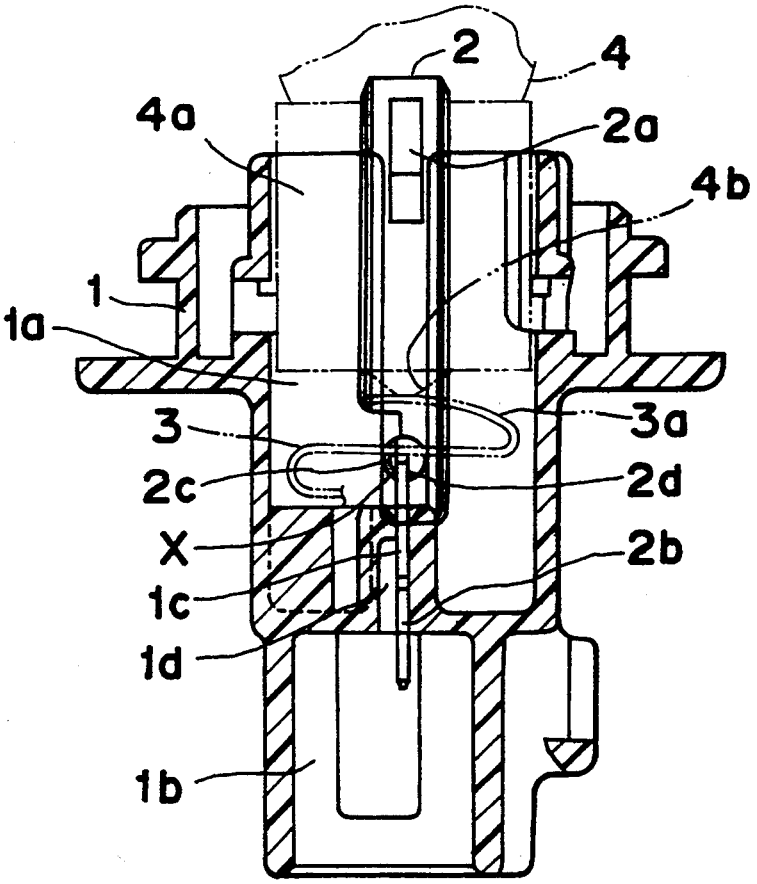
Fig. 6 PRIOR ART
FIG. 6 is a cross-sectional view schematically showing the bulb socket of FIG. 5.
Figure 7:
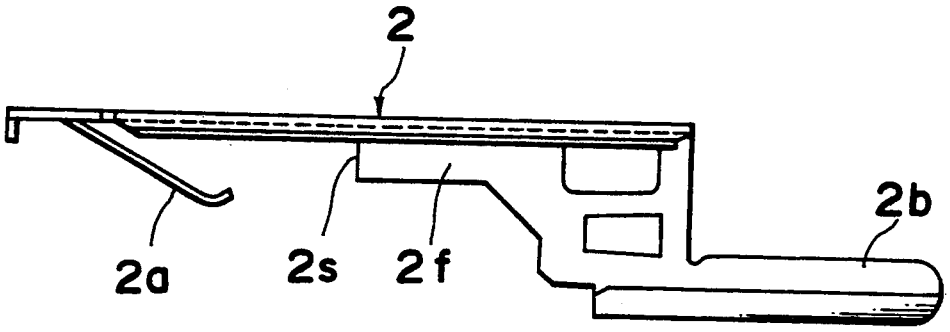
Fig. 7 PRIOR ART
FIG. 7 is a front view showing a conventional negative terminal.
Figure 8A:
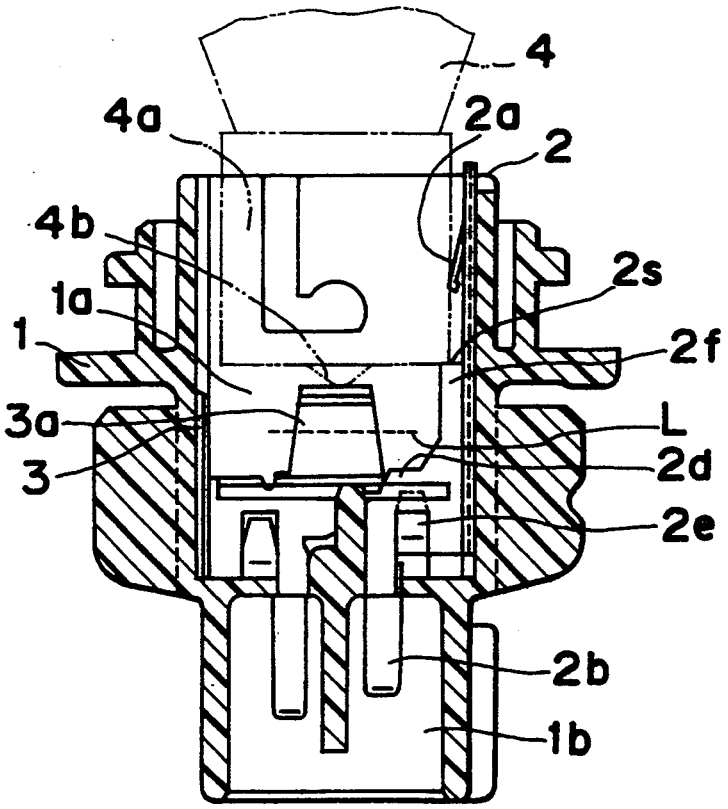
Fig. 8A PRIOR ART
FIG. 8A is a cross-sectional view schematically showing other conventional bulb socket when the negative terminal of FIG. 7 used therein is disengaged.

Referring to FIG. 4B, a relationship of the gaps between the negative terminal 11 and the positive terminal 10 are shown. As described above, since the gap G3 is greater than gap G4, the recessed base part 10*e* of the negative terminal 10 does not contact the bottom-most part of the positive terminal 11*b* thanks to the clearance hole 11*e*, even when the projection 10*c* rises up to contact with the bottom 13*s* of the bulb base 13*a*. At that time, the negative terminal 10 and the positive terminal 11 are separated with the gap G4, and the short-circuiting therebetween is prevented.

It is to be noted that the present invention is not limited to the above embodiment, and if the width of the cutout 10*f* provided in the base part 10*e* of the negative terminal 10 is increased so that contact with the positive terminals 11 does not occur before the negative terminal 10 is stopped by the projection 10*c*, the clearance channels 11*e* of the positive terminals 11 are not needed.

As will be known from the above description, because a projection 10*c* projecting toward the socket center and positioned directly below the bottom 13*s* of the bulb base 13*a* is integrally formed to the negative terminal 10, a channel-shaped recess 10*f* is provided in the top of the base member 10*e* positioned below the bottom of the positive terminals 11*b*, and the gap to the positive terminals 11*b* is increased, when the engaging piece 10*j* of the negative terminal 10 disengages from the lock channel 1*c* of the socket 1 due to vibrations, etc., and begins to come out, the projection 10*c* stops against the shoulder 13*s* of the bulb base bottom, and further removal is prevented. Because this stopped position is the position in which there is a gap G5 between the negative terminal 10 and the positive terminal 11, short-circuiting due to contact between the terminals can be prevented.

Although the present invention has been fully described in connection with the preferred embodiments with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A bulb socket for receiving a bulb having a base electrode formed on an outer perimeter of a base thereof and a bottom electrode formed on a bottom surface of said base, said bulb socket comprising:

a first terminal having a first contacting member for electric connection with said bottom electrode; and a second terminal comprising:

a second contacting member for electric connection with said base electrode;

a projection extending toward a center of the socket below said base; and a base member extending below said first terminal, said base member having a recess formed in a top surface thereof so that said second terminal does not contact said first terminal in a position when said projection contacts the bottom surface of said base.

2. A bulb socket as claimed in claim 1, wherein said first terminal has a recess formed at a side near said second terminal for accommodating said base member with a space being'kept between said first terminal and said second terminal when said projection is positioned in contact with the bottom surface of said base.

3. A bulb socket with a negative terminal and a positive terminal provided therein, whereby a bulb-side contacting member of said negative terminal contacts a negative electrode formed on an outer perimeter of a base of a bulb inserted into a bulb insertion opening formed in said bulb socket, a bulb-side contacting member of said positive terminal contacts a positive electrode on a bottom surface of said base, and a connector-side connector of said negative terminal and positive terminal contacts connectors provided in said bulb socket, said bulb socket forming said negative terminal by shaping a single metal piece, providing a projection on a flat member, providing said bulb-side contacting member extending toward the socket center directly below the bottom surface of said base, and providing a cut-out on a top surface of a base part bent in a horizontal direction perpendicular from a bottom end of said flat member, whereby said base part does not contact said positive terminal in a position when said projection contacts said bottom surface of said base.

4. A bulb socket as claimed in claim 3, wherein a double bulb having two filaments is installed in the bulb socket, two positive terminals and one negative terminal are provided inside said bulb socket, and a clearance channel is recessed in said positive terminal at the side on which said negative terminal is mounted for loosely keeping a side shoulder of said cut-out in said base part when said projection is positioned in contact with said bottom surface, said positive terminal being bent and projecting from the bottom surface of said base and contacting said positive electrode.

5. A bulb socket for receiving a bulb having a base electrode formed on an outer perimeter of a base thereof and a bottom electrode formed on a bottom surface of said base, said bulb socket comprising:

a socket body having a bulb insertion opening formed for receiving said bulb therein;

a first terminal having a first contacting member located inside said bulb insertion opening for electric connection with said bottom electrode; and a second terminal comprising:

a second contacting member extending inside said bulb insertion opening for electric connection with said base electrode;

a projection extending below said second contacting member for contact with the bottom of said base; and a base member extending below said first terminal and having a recess in a top surface thereof so as not to contact said first contacting member in a position when said projection contacts the bottom of said base.

6. A bulb socket as claimed in claim 5, wherein a double bulb includes a base electrode formed on the outer perimeter of the base thereof and first and second bottom electrodes formed on the bottom surface of said base, said bulb socket further comprising:

a third terminal having a third contacting members located beside said first terminal, said first and third terminals being able to be electrically connected with said first and second bottom electrodes, respectively, at least one of said first and third terminals being provided with a clearance channel recessed at the side adjacent said second terminal for loosely keeping a side of said base member when said projection is positioned in contact with said bottom surface.

* * * * *